United States Patent [19]

Warren

[11] 4,073,111

[45] Feb. 14, 1978

[54] INSULATED MASONRY BLOCK

[75] Inventor: Millard R. Warren, Knoxville, Tenn.

[73] Assignee: Warren Insulated Bloc, Inc., Knoxville, Tenn.

[21] Appl. No.: 768,760

[22] Filed: Feb. 15, 1977

Related U.S. Application Data

[63] Continuation-in-part of Ser. No. 649,795, Jan. 16, 1976.

[51] Int. Cl.[2] ..... E04B 2/00; E04B 5/04

[52] U.S. Cl. ..... 52/407; 52/603; 52/612

[58] Field of Search ..... 52/405, 421, 309.12, 52/407, 314, 396, 289, 250, 91, 378, 379, 406, 347, 412, 602, 408, 407, 220, 323, 604, 404, 606, 607, 605, 220

[56] References Cited

U.S. PATENT DOCUMENTS

| | | | |
|---|---|---|---|
| 1,415,222 | 5/1922 | Cramer | 52/604 X |
| 1,884,319 | 10/1932 | Smith | 52/405 |
| 2,199,112 | 4/1940 | O'Leary | 52/405 |
| 2,852,934 | 9/1958 | Amundson | 52/405 |
| 2,933,146 | 4/1960 | Zaldastani et al. | 52/405 X |
| 3,204,381 | 9/1965 | Perreton | 52/407 X |
| 3,318,062 | 5/1967 | Grants | 52/407 X |
| 3,546,833 | 12/1970 | Perreton | 52/405 X |
| 3,704,562 | 12/1972 | Grants | 52/396 |
| 3,885,363 | 5/1975 | Whittey | 52/405 X |
| 3,982,369 | 9/1976 | Keleske | 52/407 |
| 4,002,002 | 1/1977 | Bannhardt | 52/405 X |
| 4,016,693 | 4/1977 | Warren | 52/405 |
| 4,027,445 | 6/1977 | Nickerson | 52/405 |

*Primary Examiner*—Price C. Faw, Jr.
*Assistant Examiner*—Robert C. Farber
*Attorney, Agent, or Firm*—Burns, Doane, Swecker & Mathis

[57] ABSTRACT

A thermally insulated masonry block includes pairs of spaced opposed side walls and web walls defining a cavity. A rectangular thermally insulative plate is disposed in the cavity and extends from one web wall to the other. The plate and side walls are spaced apart to define air cells. At least two aligned stub walls project into the cavity from the side walls to reinforce the side walls. The stub walls are of substantially the same height as the side and web walls and are spaced apart by a distance approximating the thickness of the insulative plate.

12 Claims, 17 Drawing Figures

INSULATED MASONRY BLOCK

RELATED INVENTION

This is a continuation-in-part of co-pending and commonly assigned U.S. application No. 649,795 filed Jan. 16, 1976 by this inventor.

BACKGROUND AND OBJECTS OF THE INVENTION

The present invention relates to masonry blocks used in construction and more particularly to the thermal insulation of such a block.

The current world-wide emphasis on energy conservation has prompted the proposal of numerous techniques for thermal insulation of buildings and other structures. Heretofore, buildings have been insulated in many different ways, presenting problems of varying sorts. One common method of building construction involves the use of masonry blocks which are of concrete casting. The blocks are bonded together to form the shell of the building. Insulation of such walls by applying layers of thermally insulative material to the surfaces of these walls to meet the required thermal insulation standards involves considerable expense and loss of interior building space. These problems have prompted numerous proposals which involve the placement of a thermal insulation medium within a concrete block. In this connection, attention is directed to U.S. Pat. Nos. 1,884,319; 2,199,112; 2,852,934; 2,933,146; 3,204,381; 3,546,833 and 3,704,562 for examples of such structure.

Another proposal involves the placement of U-shaped styrofoam inserts within the recesses of concrete blocks. Each insert is installed such that the legs of the insert lie parallel to one another flush against the inside and outside walls of the block and with the bight portion of the insert lying flush against a web of the block so as to extend transverse to the inside and outside surfaces of the block.

Among the disadvantages that can arise from the previous proposals are undue cost and less than optimum thermal insulation. For instance, in cases where insulative plates or irregular shape are employed, the steps necessary to properly shape the plate are expensive. Moreover, the blocks themselves must be of special, highly intricate design to adapt to the irregularly shaped insulation members. In some instances, substantial portions of the block must be removed, thereby presenting problems regarding structural strength of the blocks, and requiring an intricate, irregularly shaped insulative plate member. Those blocks which eliminate the advantage of thermally insulative air cells, or which unduly limit the ratio between air volume and concrete volume within the block, are incapable of achieving optimum insulative results. Blocks in which an extent of the insulation extends from the outer to the inner block wall increase the thermal through-path to an undesirable degree, thereby limiting the thermal insulative effects that can be achieved.

It would be desirable from an insulative standpoint, to restrict the rate of air circulation along the recesses or cavities within a wall formed by masonry blocks. The use of insulation inserts within the recesses generally does not prevent communication between the cavities of vertically superposed blocks forming the wall. The result is an extensive air space enabling a relatively large reate of air convection to occur within the wall. The use of multi-part inserts within the block recesses, such as disclosed in aforementioned U.S. Pat. No. 2,852,934, in an attempt to restrict internal air circulation, can be quite expensive in terms of material costs as well as man hours required in assembling the blocks.

It would be further desirable to provide a thermally insulated masonry block which minimizes the thermal through-path while maintaining the structural integrity of the block and without requiring an insulative plate of such irregular shape that it cannot be economically fabricated. For instance, masonry blocks which are longer than about 10 inches generally require one or more intermediate webs to provide the necessary strength and rigidity for withstanding vertical and eccentric loading. Consequently, insulation must be provided in the form of plural inserts or a single, highly irregularly shaped insert which, in either case, adds considerable expense in the fabrication and assemblage of the block. Moreover, the intermediate web defines a thermally conducting through-path from one side to the other of the block, thereby adding significantly to the overall thermal conductivity of the block.

It is therefore an object of the present invention to provide a novel thermally insulated masonry block.

It is another object of the present invention to provide an economical and easily assembled thermally insulated masonry block which incorporates insulative air cells.

It is a further object of the invention to provide a strong insulated masonry block which minimizes the thermal through-path.

It is still another object of the invention to provide a thermally insulated masonry block which is at least 10 inches in length, exhibits substantial strength for withstanding vertical and eccentric loading, requires only a single, rectangular insulative insert for insulating the entire cavity and exhibits minimal thermal conductivity.

THE DRAWINGS

The invention is disclosed by way of preferred embodiments thereof depicted in the accompanying drawings wherein.

DETAILED DESCRIPTION

Figure 1:
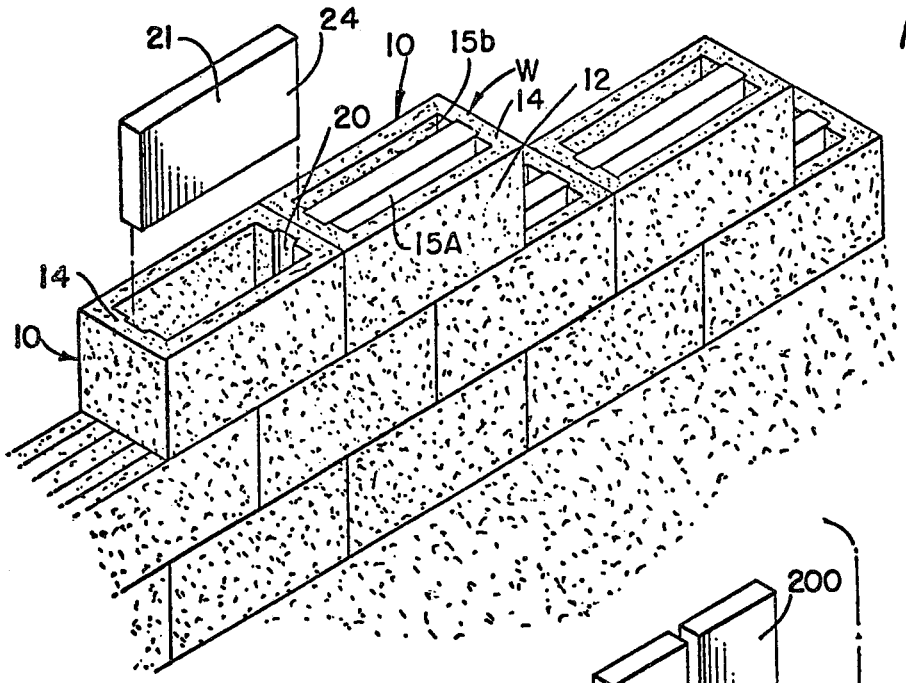
FIG. 1 depicts a plurality of insulated masonry blocks according to one embodiment of the invention in a stacked condition forming a wall.
Figure 2A:
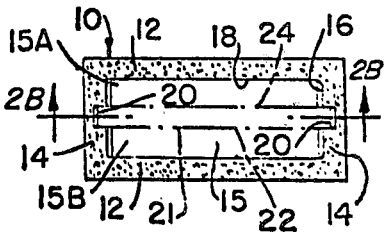
FIG. 2A is a top plan view of the block depicted in FIG. 1.
Figure 2B:
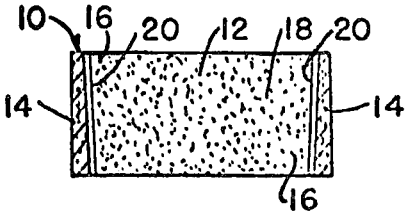
FIG. 2B is a longitudinal sectional view taken along line 2B—2B of FIG. 2A.

As disclosed in the inventor's aforementioned copending application, building blocks 10 are depicted in FIGS. 2A, 2B and in FIG. 1 forming a wall W. The block 10 includes a pair of opposed side walls 12 forming inner and outer portions of the wall W, and a pair of opposed web walls 14. Each block 10 is molded of masonry material, such as concrete, to form a hollow rectangular structure having a pair of opposed web walls 14. Each block 10 is molded of masonry material, such as concrete, to form a hollow rectangular structure having a pair of opposed side walls 12 and a pair of opposed web or tie walls 14 extending between the ends of the side walls 12. The side and web walls define a cavity 15. The side walls 12 and the web walls 14 are of substantially the same thickness and define the outermost periphery of the block. The web walls 14 have mutually facing inner surfaces 16 which extend between mutually facing inner surfaces 18 of the side walls 12.

The cavity 15 is defined by both of the side walls 12. That is, there is only one cavity disposed between and defined by both side walls 12. As will be discussed subsequently, one or more additional web walls can be provided internally of the outermost web walls to partition the sole cavity 15 into cavity portions.

Each web wall 14 includes an internal channel 20 formed approximately midway between the ends of the web wall surfaces 16. As depicted in FIG. 2B, the channels 20 are in mutually facing relation, each extending in a top-to-bottom direction of the block 10. These channels may be formed during the molding process, or may be subsequently machined into the block. The channels 20 are preferably fashioned so as to converge inwardly from top to bottom, as depicted in FIG. 2B.

Mounted within the block 10 is a plate or panel 21 formed of thermally insulative material. The insulative plate 21 is positioned such that outer faces 22, 24 thereof extend between the web wall surfaces 16 in directions parallel to the side wall surfaces 18. In this fashion, the plate 21 divides the cavity 15 into a pair of air cells 15A, B with each air cell 15A, B being bordered by: a portion of each web wall inner surface 16, one of the insulative plate faces 22, 24 and the side wall inner surface 18 which is in mutually facing relation to that inner plate face.

Thus, the arrangement is such that a masonry block 10 of substantially standard design is provided with a pair of air cells 15A, B separated by a layer of thermally insulative material for retarding heat and vapor transfer.

The type of insulative plate material to be employed, as well as its thickness, depends upon the degree of resistance to thermal conductivity that is desired. Possible types of insulative material include polystyrene, urethane, styrofoam, and fiberglass.

In use, the concrete block 10 is precast in a conventional manner. Suitable channels 20 can be formed during molding or machined into the web walls 14 subsequent to the molding operation. The insulative plate 21 is manually press-fitted into the channels 20. The convergent nature of the channels 20 causes the plate to be slightly compressed into a snug fit within the block. Insertion of the insulation plates can be accomplished at the block fabrication facility, or can be performed later at a building site.

The blocks 10 are used in a conventional manner in the erection of a structure as shown in FIG. 1. That is, the blocks 10 are laid-up in staggered or non-staggered relation, with the side walls 12 forming the interior and exterior wall surfaces of the structure. The insulative plates can be inserted before or after a row of blocks are laid-up merely pressing the plate into the channels 20. The convergent nature of the channels serves to firmly hold the plate in place. Bonding of the blocks together can be performed by conventional mortar application between blocks or by the application of a bonding resin to the exterior of the structure. One conventional type of such resin is sold by Owens-Corning Fiberglass Company under the trade name BlocBond. This resin has a portland cement base and is reinforced with fiberglass. Application of the resin is made in a one-eighth inch layer onto the exterior and interior surface of a wall of freestanding blocks. By thus eliminating the use of a mortar and amound of non-insulated wall area is significantly reduced.

Since the block of the present invention involves only a pair of side walls with only one cavity disposed therebetween, the ratio or air volume to concrete volume is maximized to retain a high insulative factor. In certain prior art proposals there are employed a plurality of staggered cavities between the side walls, the added presence of masonry between the staggered cavities serving to reduce the air/concrete ratio.

Furthermore, the block of the present invention provides plural air gaps or cells 15A, B to retard thermal conductivity. It is expected that a significantly higher insulative factor is achieved when the insulative plate is disposed in spaced relation from both of the side walls 12, as opposed to being situated flush against one or both of the side walls.

Importantly, no portion of the insulative plate of the present block extends from one side wall to the other in flush engagement with a web wall, thus avoiding an enlargement of the effective heat transfer path.

Since the insulative plate 21 of the present invention extends across only one major dimension of the cavity 15 (i.e., parallel to the side walls) and since only one cavity is disposed between the side walls, only a minimal amount of insulative material is required per block.

Insulative materials of a waterproof nature, such as those previously listed, can be routinely employed to prevent the occurrence of water damage to the plates, especially during inclement conditions at the construction site.

Figure 3A:
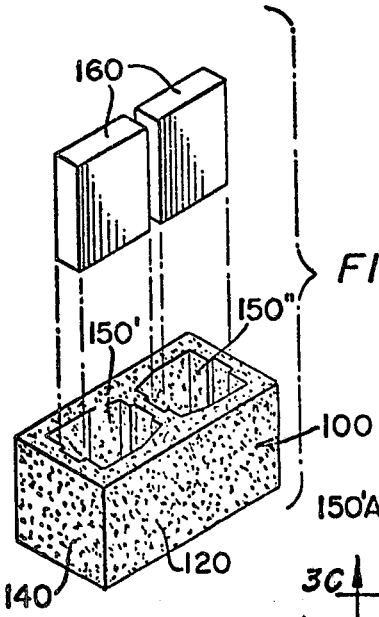
FIG. 3A is an exploded isometric view of another preferred form of insulated masonry block according to the present invention.
Figure 3B:
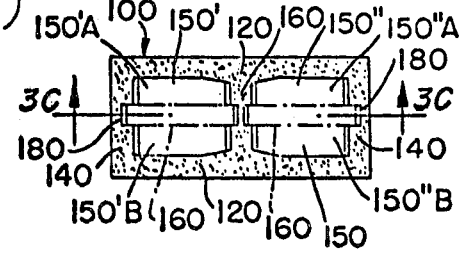
FIG. 3B is a top plan view of the block depicted in FIG. 3A.
Figure 3C:
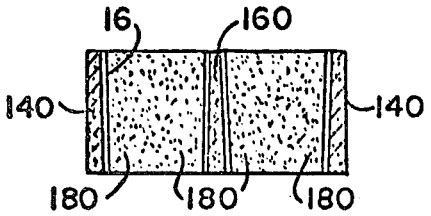
FIG. 3C is a longitudinal sectional view taken along line 3C—3C of FIG. 3B.

The previously discussed principles and advantages can be incorporated with conventional masonry blocks of various design. FIGS. 3A–C depict a standard block 100 in which a pair of side walls 120 and web walls 140 define the outer periphery of the block and an inner cavity 150. The inner cavity 150 is partitioned into cavity portions 150', 150'' by an intermediate web wall 160. Thus, the block 100 is characterized by a single cavity 150 disposed between and defined by the side walls 120, with the cavity 150 being divided into a plurality of cavity portions 150', 150'' between the outer web walls 140.

Within each of the cavity portions 150', 150'' an insulative plate portion 160 of the type previously discussed can be manually inserted. The insulative plate portion 160 is inserted into downwardly convergent channels 180 formed in the outer web walls 140 and intermediate web wall 160. As a result, each insulative plate partitions its respective cavity portion into a pair of air cells 150'A, B and 150''A, B.

Figure 4:
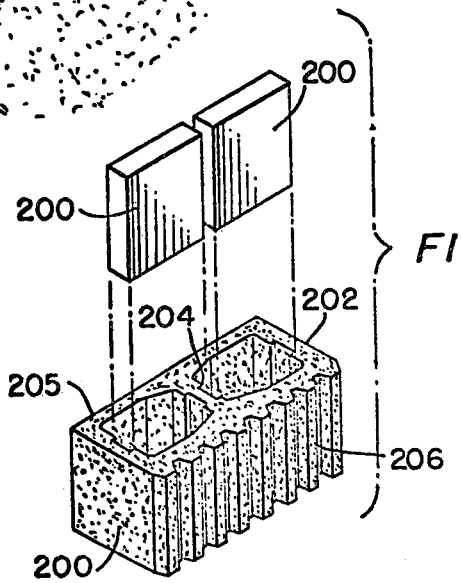
FIG. 4 is an exploded isometric view of another preferred form of insulated block according to the present invention.

In FIG. 4 the use of insulative plates 200 is depicted in conjunction with a conventional block 202 having an intermediate web wall 204, a planar side wall 205 and a corrugated side wall 206.

It will thus be realized that the embodiments disclosed in conjunction with FIGS. 3 and 4 are characterized by the provision of a masonry block having only a single cavity interposed between and defined by the side walls, and plural air cells separated by a layer of insulation, as in the manner of the embodiment disclosed in conjunction with FIGS. 2A, 2B.

Blocks of a design other than that depicted in FIGS. 2, 3 and 4 and other than a standard design can, if desired, be utilized in accordance with the aforestated principles of the invention.

Figure 5:
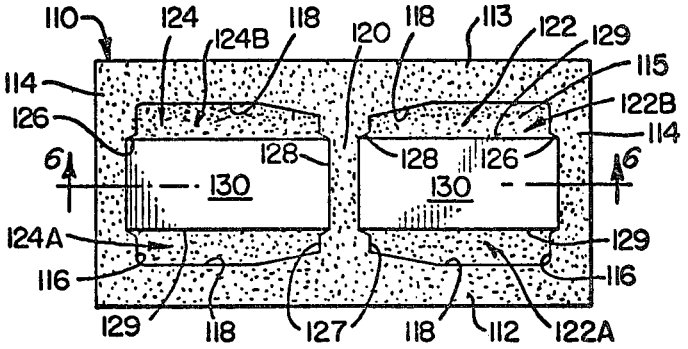
FIG. 5 is a plan view of a modified form of insulative block according to the present invention.

In FIGS. 5–8 there is depicted an insulative block which effectively minimizes air convection within a construction wall. In FIG. 5, a block 110 is shown having front and rear opposed side walls 112, 113 and a pair of opposed end web walls 114. The side and end web walls define a cavity 115 therebetween. The side walls 112, 113 and the end web walls 114 are of substantially the same thickness and define the outermost periphery of the block. The end web walls 114 have mutually facing inner surfaces 116 which extend between mutually facing inner surfaces 118 of the side walls 112, 113.

The cavity 115 is defined by both of the side walls. That is, there is only one cavity 115 disposed between and defined by both side walls 112, 113. An intermediate web wall 120 is provided internally of the end web walls 114 to partition the cavity 115 into cavity portions 122, 124.

Figure 6:
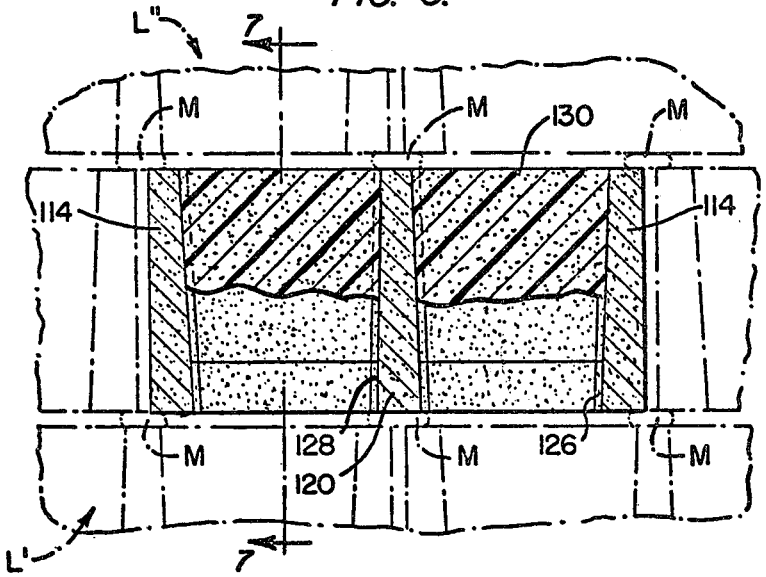
FIG. 6 is a longitudinal sectional view taken along line 6—6 of FIG. 5 and depicting a wall formed by blocks of the present invention laid up by mortar.

Each end web wall 114 includes an internal channel 126 formed approximately midway between the ends of the end web wall surfaces 116. As depicted in FIG. 6, these channels are in mutually facing relation, such extending in a top-to-bottom direction of the block 110. Such channels may be formed during the molding process, or may be subsequently machined into the block, and are preferably fashioned so as to converge inwardly from top to bottom, as depicted in FIG. 6.

The intermediate web wall has inner faces 127 in which are formed a pair of upright channels 128 each of which face one of the end web wall channels 126.

Mounted within the block 110 are a pair of plate or panel portions 130 formed of thermally insulative material. Each insulative plate 130 is positioned such that outer faces 129 thereof extend between the web wall surfaces 116 in directions parallel to the side wall surfaces 118. In this fashion, the plates 130 divide each cavity portin 122, 124 into a pair of air cells 122A, B; 124A, B, with each such air cell being bordered by: a portion of one end web wall inner surface 116, a portion of one of the intermediate web wall faces 127, one of the insulative plate faces 129, and the side wall inner surface 118 which is in mutually facing relation to such plate face.

Thus, the arrangement is such that a masonry block 110 is provided with a plurality of air cells separated by a layer of thermally insulative material for retarding heat and vapor transfer.

The type of insulative plate material to be employed, as well as its thickness, depends upon the degree of resistance to thermal conductivity that is desired. Possible types of insulative material include polystyrene, urethane, styrofoam, and fiberglass.

At their bottom ends, the side walls each include a projecting barrier portion 132 (FIG. 7) which projects toward one of the surfaces 129 of the insulative plate 132 and at least substantially into engagement therewith. The barrier portions 132 are formed by downward and inward tapers 134 of the side walls which terminate in the bottom plane of the block. Consequently, the side walls 112, 113 each comprise an upper portion which is spaced from one of the plate surfaces 129 to define the air cells 122A, B or 124A, B, and another, lower portion 132 which is at least in substantial engagement with both surfaces of the plate. The air cells thus extend from one web wall 114 to another 120 and are blocked therealong by air barriers formed by the barrier portions 132.

The blocks 110 can be conveniently molded in a manner incorporating the barrier portions. The number and location of the barrier portions 132 is optional. Such barrier portions can be disposed at the base of the side walls and/or at the top thereof, and/or vertically therebetween.

Figure 7:
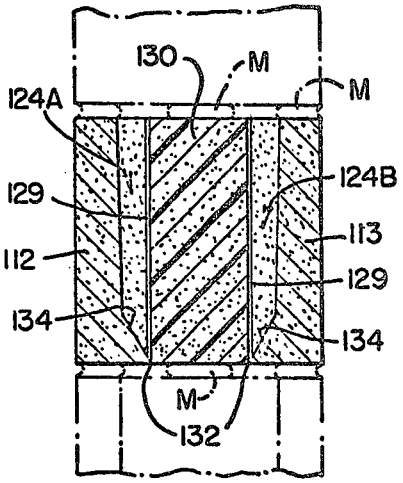
FIG. 7 is a vertical cross-sectional view taken along line 7—7 of FIG. 6.
Figure 8:
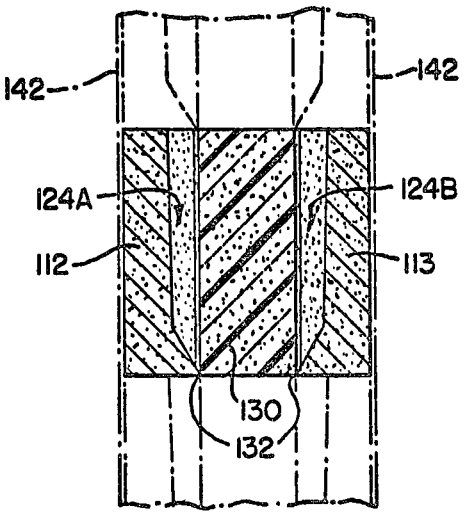
FIG. 8 is a cross-sectional view similar to FIG. 7 depicting a wall of blocks that have been laid up by a bonding resin.

During assemblage of the blocks 110 into a wall structure, a layer L' of blocks is laid and mortar layers M are deposited on the top face of each block 1 as defined by the upper edges of the side walls and web walls (FIG. 6). A layer of mortar M is also deposited entirely along the top edge of the insulation plates 130 (FIG. 7). Another layer L'' of blocks is than assembled atop the first layer. The mortar layers situated between the two block layers function to bond the blocks together and to seal off the air cells 122A, B; 124A, B. Particularly, the mortar along the plates seals the front air cells of each block from the rear air cells. Consequently, the air within each air cell is confined at the bottom by the barrier portion 132 of the associated block; at the top by the barrier 132 of the block thereabove and the mortar joints along the side walls, web walls and insulative plate; and at the ends by the web walls. The air is thus effectively contained within the height of the block, thereby minimizing the rate of air convection that can occur within the wall.

It is noted that the barrier portions 132 are preferably spaced apart by a distance equal to or slightly less than the expected width of the insulative plate 130 so as to assure a tight fit between the plate and the barrier portions.

To assemble the blocks 110 and the insulative plates 130, it is merely necessary to cut stock plate material to the necessary length, i.e., larger than the distance between the layer ends of the channels 126, 128 and equal to or shorter than the distance between the upper ends of these channels. The plates are then pressed into the channels 126, 128 so that the parallel upright ends of the plates are compressed, or wedged into firm engagement with the convergent channels 126, 128.

It should be noted that a wall of blocks 110 can be laid up by means of the bonding resin process described previously, and as depicted in FIG. 8. In such instance, the air cells 122A, B; 124A, B are sealed by means of the inner and outer layers 142 of bonding resin, the barrier portions 132 of vertically adjacent blocks, and contact between the vertically superposed insulative plates 130. Thus, the height of the air cells is limited to minimize the rate of convection, and the travel of warm air from the inner air cells to the colder air in the outer air cells is resisted.

Figure 9:
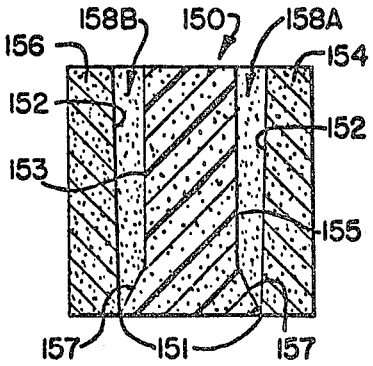
FIG. 9 is a cross-sectional view of a modified form of block depicted in FIG. 5.
Figure 10:
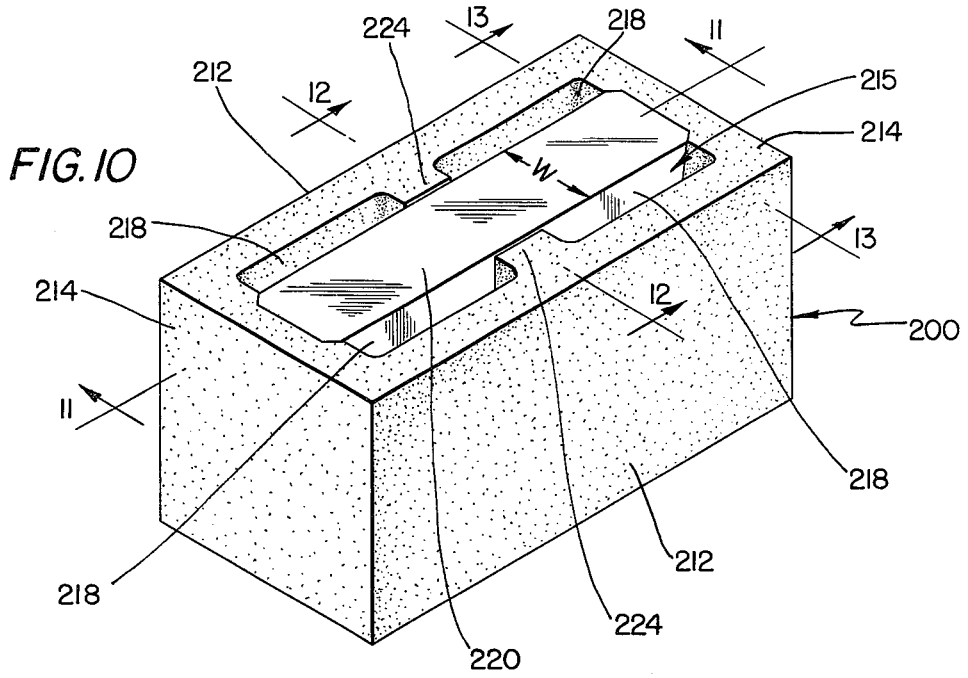
FIG. 10 is a perspective view of a masonry block with a thermal insulating plate disposed therein, according to the present invention.
Figure 11:
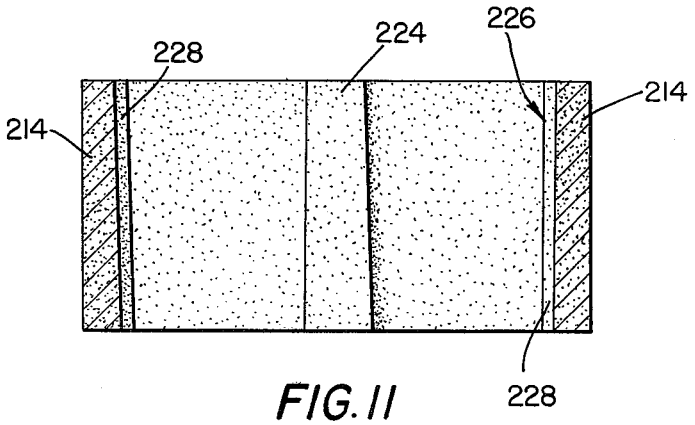
FIG. 11 is a longitudinal sectional view taken centrally through the block along line 11—11 in FIG. 10, with the insulation insert removed.
Figure 12:
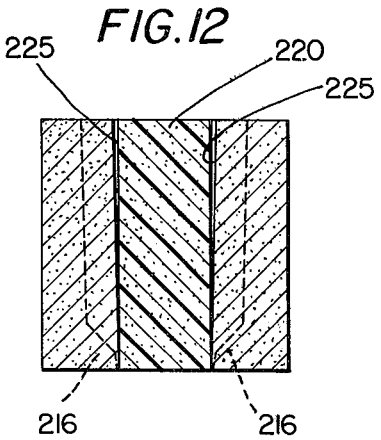
FIG. 12 is a cross-sectional view taken centrally through the block along line 12—12 in FIG. 10, with the insulation insert in place.
Figure 13:
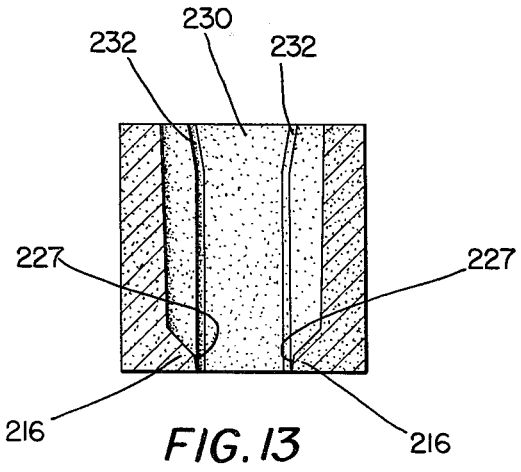
FIG. 13 is a cross-sectional view taken through the block along ine 13—13 in FIG. 10, with the insulation plate removed.

In a modified form, depicted in FIG. 9, the insulative plate 150 comprises a one-piece element which includes integral barrier portions 151 projecting from opposite surfaces 153, 155 of the plate toward inner surfaces 152 of the side walls 154, 156. These barrier portions are established by downwardly and outwardly tapered sections 157. Thus, in such a case as well as previously, an upper portion of each plate 150 is spaced from the block side walls to define an air cell 158A or B and another, integral, lower portion 151 of the plate at least substantially engages the side walls to form an air barrier extending across the air cell from one to another web wall. In such an arrangement, the upper and lower extents of the insulative plate are preferably situated within the upper and lower planes of the block.

It should be realized that while the block disclosed in conjunction with FIGS. 5–9 has been discussed as having end web walls and at least one intermediate wall, it will be realized that a masonry block having no intermediate web wall, such as depicted in FIG. 1, may be employed. In such an instance, the projecting barrier portions 132 or 151 would extend from one end web wall to the other.

In FIGS. 10–14, a particularly advantageous embodiment of a masonry block according to the present invention is depicted. The block 200 includes pairs of spaced parallel web walls 214 and spaced parallel side walls 212 forming the outer periphery of the block and defining therebetween a single cavity 215. The block 200 is of rectangular configuration. Each of the side walls 212 preferably includes an inwardly projecting barrier portion 216 (FIG. 12), similar to that disclosed earlier in conjunction with the embodiments of FIGS. 7 and 8 to close-off air cells 218 formed within the block on opposite sides of a thermally insulative plate 220.

The plate 220 is formed of a thermally insulative material, preferably polystyrene or polyurethane, and is of a compressible nature as previously discussed. The plate 220 is of substantially rectangular configuration to facilitate forming of the plates which is usually accomplished by cutting the plates from large sheets of material.

Disposed intermediate the web walls 214, preferably midway therebetween, are a pair of stub walls 224. The stub walls 224 are integrally formed with the side walls 212 and project therefrom into the cavity 215 in opposed, mutually aligned relation. The inner ends of the stub walls 224 are spaced from one another in a direction perpendicular to the side walls 212 by a distance approximating the width W of the insulative plate 220. The stub walls 224 each extend substantially the full height of the side and web walls.

Preferably, the inner, mutually facing surfaces 225 of the stub walls are slightly divergent in an upward direction to facilitate insertion of the insulative plate 220. The lower ends of the stub wall surfaces 225 engage the insulative plate 225 to close-off the air gaps 218 and aid in securing the plate 220 in place.

At this point, it should also be noted that the end surfaces 227 of the barrier portions 216 of the block are also divergent upwardly for the similar purpose facilitating insertion of the plate 220.

The stub walls 218 are preferably formed integrally with the side walls at the time of block fabrication by a molding process. The stub walls 218 provide substantial stiffness to the side walls 212 during molding and also during cooling to prevent the formation of unwanted curvature. Moreover, when the blocks are laid-up to form a wall, the stub walls considerably increase the compressive strength of the side walls. The blocks are thus able to withstand vertical loading, especially eccentric loading, in favorable comparison to comparably sized blocks having one or more intermediate web walls which extend from one side wall to the other. These effects are preferably achieved by stub walls which are of substantial thickness. That is, the thickness of each stub wall 224 is greater than either of the web walls 214.

Each web wall 214 includes an inwardly open channel 228 for receiving the ends of the insert 220 so that the insert extends completely across the cavity. The channels 228 diverge downwardly to produce a compression of the insert 200, as previously discussed.

Each channel 228 includes spaced apart end walls 232 (FIG. 13) whose upper portions are mutually divergent in an upward direction to facilitate receiption of the plate 220. The lower portions of the end walls 232 are substantially parallel.

Figure 14:
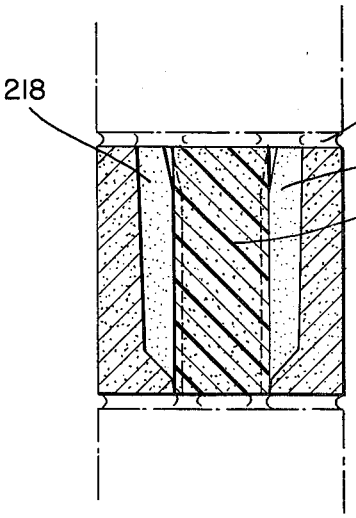
FIG. 14 is a cross-sectional view of a block forming part of a structural wall, the section being taken in the region of line 13—13 with the insert in place.

To erect a wall of the insulated blocks 200, a plurality of blocks, with insulative plates 220 previously installed therein, are laid-up and secured by mortar joints M in conventional fashion (FIG. 14). It may be desired to utilize conventional Z-shaped wire wall ties embedded within the mortar joint above the stub walls 224 so as to extend above and across the gap between the stub walls 224. The air cells 218 on either side of the plate 220 are closed off at their top and bottom ends by the barrier portions 216 of vertically adjacent blocks to minimize air circulation within the wall.

It will be realized tha the masonry block 200, while being very strong, posses a very low U-factor. The stub walls 224 perform a strengthening function heretofore performed by a web wall extending from one side wall to the other. Since the stub walls 224 are spaced, the uninterrupted thermal through-path is not present. Rather, effective insulative properties are provided by the insulative plate 220, as well as by the air spaces between the upper ends of the stub walls 224 and the insulative plate. Also, since the stub walls are spaced, they add less weight to the block than would a normal web wall and accommodate a single insulative insert, rather than a plurality of inserts.

The attainment of low U-factors constitutes a major advancement in optimizing the performance of masonry construction blocks, thereby expanding their utility. Realization of low U-factor levels is achieved without sacrificing significant block strength, due to the presence of the reinforcing stub walls. Moreover, the block can be utilized in conjunction with insulative plates of easy-to-form rectangular shape, thereby avoiding the substantial costs involved in forming irregularly shaped insulative members.

As noted previously, closing-off of the air gaps by the barriers 216 and the lower portions of the stub walls 224 also contributes to the low thermal conductivity of the block, and is achieved without the need for special or irregularly shaped insulative inserts.

Although the invention has been described in connection with a preferred embodiment thereof, it will be appreciated by those skilled in the art that additions, modifications, substitutions and deletions not specifically described may be made without department from the spirit and scope of the invention as defined in the appended claims.

What is claimed is:

1. A thermally insulated masonry block comprising:
pairs of spaced opposed side walls and spaced opposed web walls defining a cavity therebetween;
a rectangular-shaped insulative plate formed of thermally insulative material disposed in said cavity and extending from one to the other of said web walls;
said insulative plate and said side walls being spaced apart to define air cells on opposite sides of said insulative plate; and
at least two aligned stub walls projecting into said cavity from respective ones of said side walls to reinforce said side walls;
said stub walls being of substantially the same height as said side and web walls and being spaced by a distance approximately the same as the thickness of said insulative plate.

2. An insulated masonry block according to claim 1 wherein said stub walls are each thicker than said web walls.

3. An insulated masonry block according to claim 1 wherein said stub walls include inner surfaces facing said insulative plate, said surfaces being divergent in an upward direction at least along an upper portion thereof to facilitate insertion of said insulative plate.

4. An insulated masonry block according to claim 1 wherein each of said web walls includes an inwardly open channel for receiving an end portion of said insulative plate; said channels each being upwardly divergent at least at an upper portion thereof to facilitate insertion of said insulative plate.

5. A thermally insulated masonry block comprising:
pairs of spaced opposed side walls and spaced opposed web walls defining a cavity therebetween;
a substantially rectangular-shaped insulative plate formed of thermally insulative material disposed in said cavity and extending from one to the other of said web walls;
said side walls including:
first portions spaced from said insulative plate to define air cells therebetween,
barrier portions projecting toward said insulative plate and having ends spaced apart by a distance substantially the same as the thickness of said insulative plate to form air barriers across both air cells; and
at least two aligned sub walls projecting into said cavity from respective ones of said side walls to reinforce said side walls;
said stub walls being of substantially the same height as said side and web walls and being spaced by a distance approximately the same as the thickness of said insulative plate.

6. An insulated masonry block according to claim 5 wherein said stub walls are each thicker than said web walls.

7. An insulated masonry block according to claim 5 wherein said stub walls include inner surfaces facing said insulative plate, said surfaces being divergent in an upward direction at least on an upper portion thereof to facilitate insertion of said insulative plate.

8. An insulated masonry block according to claim 5 wherein each of said web walls includes an inwardly open channel for receiving an end portion of said insulative plate; said channels each being upwardly divergent at least at an upper portion thereof to facilitate insertion of said insulative plate.

9. A thermally insulated masonry block comprising:
pairs of spaced opposed side walls and spaced opposed web walls defining a single cavity therebetween;
said web walls each including an upright channel disposed on an inner surface thereof;
a rectangular-shaped insulative plate formed of thermally insulative material disposed in said cavity and extending from one to the other of said channels and extending essentially the entire height of said web and side walls;
said side walls include:
upper portions spaced from said insulative plate to define air cells therebetween, and
lower portions projecting toward the lower end of said insulative plate and having ends spaced apart by a distance substantially equal to the thickness of said insulative plate so that said second portions engage said insulative plate to form air barriers across the bottoms of both air cells; and
at least one pair of aligned stub walls projecting into said cavity from respective ones of said side walls to reinforce said side walls;
said stub walls being thicker than said web walls, and being spaced apart along their entire height by a distance sufficient to accommodate insertion of said insulative plate.

10. A block according to claim 9 wherein said stub walls include inner faces which are divergent in an upward direction; the spacing between said inner faces at their lower ends being equal to the thickness of said insulative plate to frictionally grip the lower end of said plate.

11. A block according to claim 10 wherein said stub walls consist of one pair disposed midway between said web walls.

12. A block according to claim 11 wherein each of said channels is upwardly divergent at least at the upper end thereof to facilitate insertion of said insulative plate.

* * * * *